United States Patent [19]

Allen

[11] Patent Number: 5,031,555

[45] Date of Patent: Jul. 16, 1991

[54] NEUTRAL BUOYANCY DEVICE

[75] Inventor: David P. Allen, P.O. Box 3284, Morgan City, La. 70381

[73] Assignee: David P. Allen, Patterson, La.

[21] Appl. No.: 473,596

[22] Filed: Feb. 1, 1990

[51] Int. Cl.[5] ..... B63C 7/00

[52] U.S. Cl. ..... 114/52; 114/50

[58] Field of Search ..... 114/50–54, 114/315, 312; 441/28, 29, 21; 405/185

[56] References Cited

U.S. PATENT DOCUMENTS

| | | | |
|---|---|---|---|
| 2,412,205 | 12/1946 | Cook | 114/54 |
| 2,635,574 | 4/1953 | Sturtevant | 114/54 |
| 4,498,408 | 2/1985 | Otteblad et al. | 114/54 |
| 4,658,745 | 4/1987 | Buecher | 114/50 |

*Primary Examiner*—Ed Swinehart

[57] ABSTRACT

A neutral buoyancy device, (NBD), includes a lift volume container, load suspension straps, control mechanism, handle, self-closing intake and exhaust valves and valve actuators. A high pressure air source is provided by attaching a pressure cylinder to the NBD or from the surface. The handle is attached to the control mechanism, which is positioned between the lift volume container and load. The control mechanism senses any net difference in lift and load forces and causes the intake valve to open automatically when the load increases, (or as the air volume and lift decrease during descent), and the exhaust valve to open automatically when the load decreases, (or as the air volume and lift increase during ascent). Both valves are self-closing. The user grasps the handle and is able to load or unload the NBD, or transport the load up, down or sideways underwater while neutral buoyancy is automatically maintained.

1 Claim, 2 Drawing Sheets

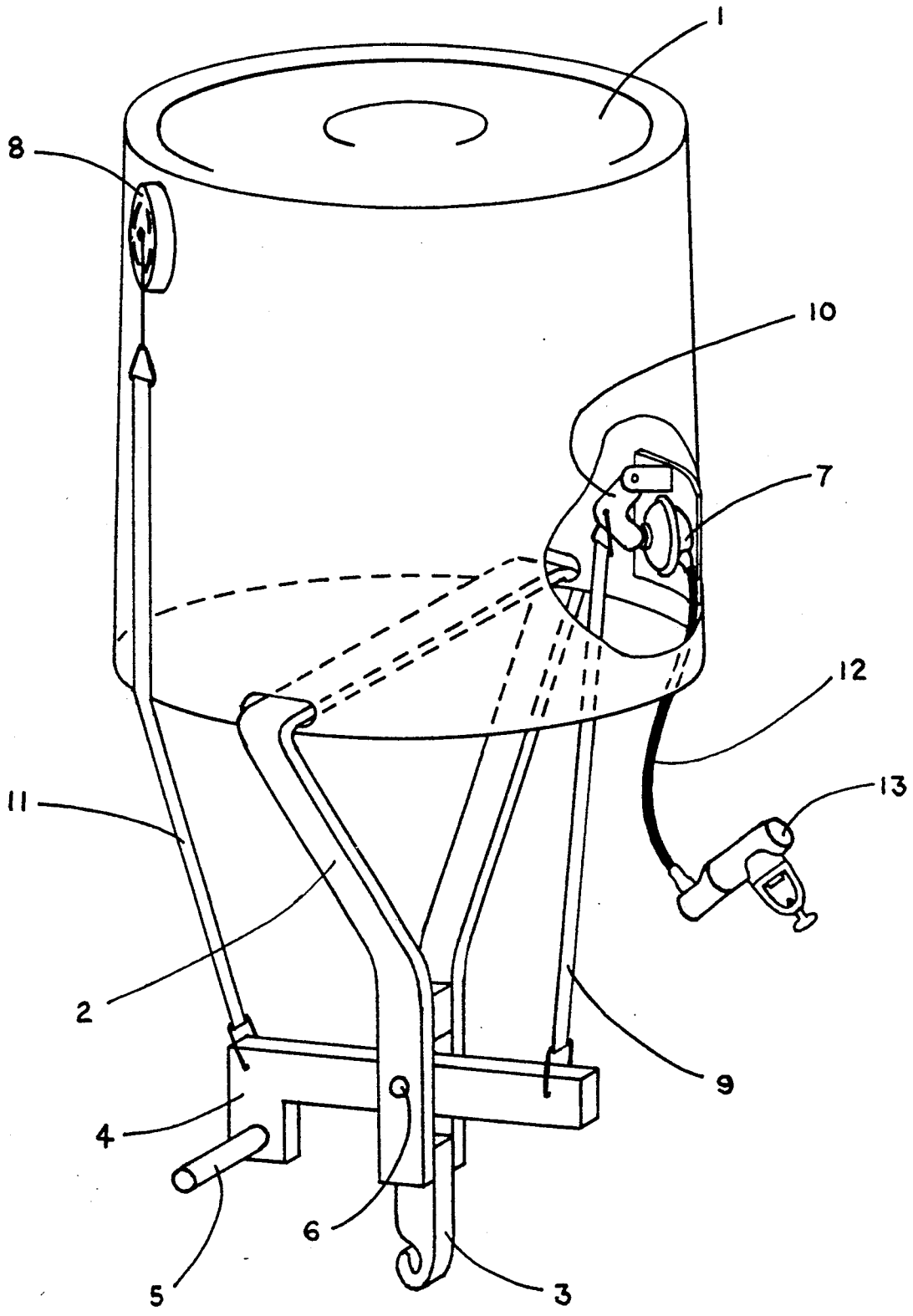
FIG, 1

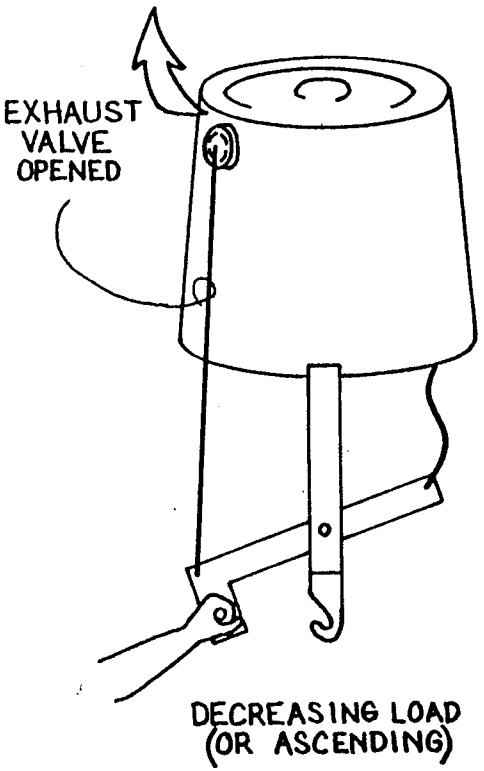
FIG. 2c
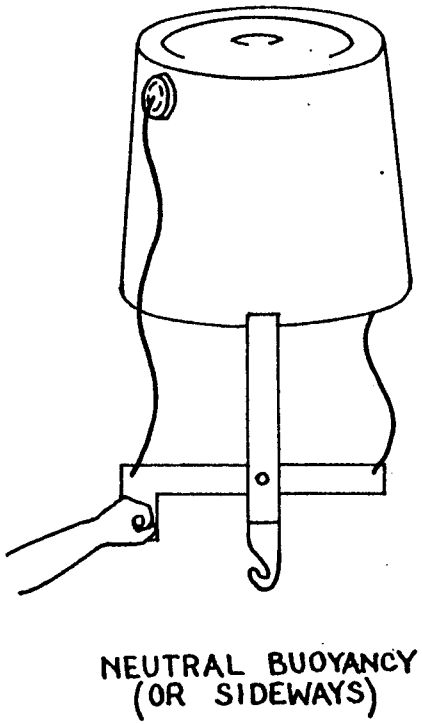
FIG. 2b
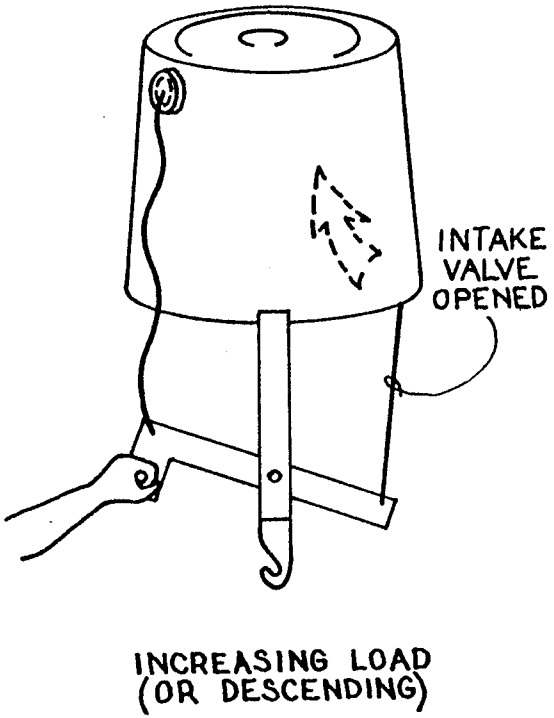
FIG. 2a
FIG. 2

NEUTRAL BUOYANCY DEVICE

BACKGROUND OF THE INVENTION

This invention relates to sub-surface lifting methods for transporting or salvaging loads underwater. It provides significant practical and safety improvements over conventional lift bags and surface cranes.

Conventional lift bags employ an exhaust valve near the top of the bag which the user must manually vent when reducing lift or ascending. During ascent, if the exhaust valve does not vent the expanding air fast enough, (air expands, quadrupling in volume between 100 feet seawater and the surface), the load can accelerate upward out of control. By automatically venting the expanding air, the neutral bouyancy device, (NBD), eliminates any guesswork by the user, allowing him/her to concentrate solely on a controlled ascent, resulting in a safer operation. In addition, a conventional lift bag used by a scuba diver is often inflated by using the divers mouthpiece regulator and his/her own breathing air supply. The NBD precludes the risk of the diver removing the mouthpiece regulator from his/her mouth and conserves the limited supply of breathing air.

Lifting a submerged load with a surface crane presents practical problems which are overcome by use of the NBD. If the crane platform, (e.g. a boat or barge), is affected by surface swell, this movement is transmitted to the load. This situation often leads to sudden and dangerous loading and unloading of the crane as well as danger to the diver from sudden load movement. The NBD eliminates movement from these surface effects, even in shallow water. In addition, a crane must be positioned directly above the load. The NBD allows the user to transport the balanced load, both sideways and vertically, around and under obstructions. Expensive marine equipment time is also saved by not having to re-locate and re-anchor the crane platform.

SUMMARY OF THE INVENTION

The neutral buoyancy device, (NBD), provides a safer and more practical tool for handling loads underwater than either conventional liftbags or surface cranes. By automatically balancing lift and load forces the user is freed from the guesswork and inconvenience of manually adding or venting air. Independent of the surface, the motion of a floating crane is eliminated, as well as the requirement for the crane to be located directly above the load. The following discussion is keyed to FIG. 2 and serves to illustrate the operation of the NBD.

FIG. 2*a*—INCREASING LOAD, (OR DESCENDING)

Holding the handle stationary, weight is added to the NBD. This causes the control mechanism to open the intake valve, increasing lift to balance the increasing load. (When descending air compresses, decreasing lift, and again the control mechanism opens the intake valve to maintain a fixed displacement volume to balance the load.)

FIG. 2*b*—NEUTRAL BUOYANCY, (OR SIDEWAYS)

Holding the handle stationary, load and lift forces are balanced. This causes the control mechanism to close both valves, maintaining the balance. (When traveling sideways the lift volume and the load remain constant, the control mechanism remains stationary, and the balance is maintained.)

FIG. 2*c*—DECREASING LOAD, (OR ASCENDING)

Holding the handle stationary, weight is removed from the NBD. This causes the control mechanism to open the exhaust valve, decreasing lift to balance the decreasing load. (When ascending air expands, increasing lift, and again the control mechanism opens the exhaust valve to maintain a fixed lift volume to balance the load.)

BRIEF DESCRIPTION OF THE DRAWINGS

FIG. 1 is an isometric view of a neutral buoyancy device, (NBD), according to a typical embodiment.

FIG. 2 shows the control mechanism in three different loading conditions and how the valves are actuated to maintain neutral buoyancy.

FIG. 2*a* shows the condition of increasing the load, which results in opening the intake valve to compensate and maintain neutral buoyancy. (This condition also occurs during descent as the air in the lift volume container is compressed and lift is reduced.)

FIG. 2*b* shows the condition of balanced lift and load forces resulting in neutral buoyancy and in closing both intake and exhaust valves. (This condition also occurs when moving the load sideways as the air in the lift volume container maintains a constant lift volume.)

FIG. 2*c* shows the condition of decreasing the load, which results in opening the exhaust valve to compensate and maintain neutral buoyancy. (This condition also occurs during ascent as the air in the lift volume container expands and lift is increased.)

DETAILED DESCRIPTION OF THE PREFERRED EMBODIMENT

Reference will made to the embodiment illustrated in the drawings and specific language will be used to describe the invention. Nevertheless, it will be understood that no limitation on the scope of the invention, nor other means of achieving the basic purposes of the components is thereby intended. Some possible alterations and further modifications of the principles of the invention are mentioned below in parenthesis. Only one configuration of the invention has been shown and all alterations and further modifications within the spirit of the invention are desired to be protected.

FIG. 1 illustrates a neutral buoyancy device, (NBD). A lift volume container 1, is sized according to the weight to be handled. (In this example a rigid cylindrical container is used but any rigid, semi-rigid, or fabric container could serve the basic purpose.) Load suspension straps 2, connect the lift volume container 1, to a load hook 3. A control mechanism 4, and a handle 5, are positioned between the lift volume container 1, and the load hook 3. The control mechanism 4, rotates on a pivot axis 6, and is connected to a self-closing intake valve 7, and a self-closing exhaust valve 8. (In this example the intake valve is a standard scuba mouthpiece regulator and the exhaust valve is a standard dump valve used on conventional lift bags. However, any self-closing valves could be used to serve the basic purpose. The control mechanism shown is a simple lever but many other configurations of this mechanism are possible.) A flexible strap 9, is used to connect the control mechanism 4, to a rocker arm 10, which opens the intake valve by pressing against the mouthpiece regulator purge button.

Another flexible strap 11, is used to connect the control mechanism 4, to the exhaust valve 8. (Alternate means of signaling the self-closing valves, such as cables, electrical signal/electromechanical valve actuators or hydraulic lines/hydraulic valve actuators or pneumatic lines/pneumatic valve actuators could be used to serve the basic purpose.) A high pressure supply air hose 12, is connected to a standard scuba first stage regulator 13, for connection to a compressed air cylinder, not shown, which will then be attached to the NBD. (Many sources of compressed air are possible including running the supply air hose 12, from a surface compressor or bank of air cylinders.)

What is claimed is:

1. In combination:

neutral buoyancy device for handling loads underwater comprised of:

means of containing a water-displacing volume of compressed air;

means of suspending a load from said means of containing;

means of adding and/or deleting compressed air to and/or from said means of containing;

means of controlling the automatic addition and/or deletion of compressed air to and/or from said means of containing;

said means of controlling utilizing the reaction of the neutral buoyancy device against an essentially stationary point, to automatically add and/or delete compressed air, thus continually maintaining neutral buoyancy regardless of any increase and/or decrease in load, and regardless of pressure-volume changes of the compressed air during vertical descent and/or ascent.

* * * * *